US006966084B2

(12) United States Patent
Le Gette et al.

(10) Patent No.: US 6,966,084 B2
(45) Date of Patent: Nov. 22, 2005

(54) SUPPORT AND METHOD OF USING THE SAME

(75) Inventors: Brian E. Le Gette, Baltimore, MD (US); William G. Phelps, Jr., Parkville, MD (US); David L. Reeb, Columbia, MD (US); Walter Paul Robinette, II, Canal Winchester, OH (US); Alan Tipp, Ellicott City, MD (US); Justin Saul Werner, Millersville, MD (US)

(73) Assignee: Kelsyus, LLC, Virginia Beach, VA (US)

( * ) Notice: Subject to any disclaimer, the term of this patent is extended or adjusted under 35 U.S.C. 154(b) by 0 days.

(21) Appl. No.: 10/414,496

(22) Filed: Apr. 16, 2003

(65) Prior Publication Data

US 2004/0206861 A1 Oct. 21, 2004

(51) Int. Cl.[7] ..... A45F 3/24
(52) U.S. Cl. ..... 5/129; 5/127; 5/115
(58) Field of Search ..... 5/129, 127, 123, 5/122, 120, 112, 114, 115, 182; 297/16.1, 297/16.2

(56) References Cited

U.S. PATENT DOCUMENTS

| | | | | | |
|---|---|---|---|---|---|
| 7,712 | A | * | 10/1850 | Whitmarsh | 5/115 |
| 314,986 | A | | 4/1885 | Aenis | |
| 342,668 | A | * | 5/1886 | Woodbury | 5/122 |
| 398,943 | A | * | 3/1889 | Crandall | 297/45 |
| 506,776 | A | | 10/1893 | Ford | |
| 531,727 | A | | 1/1895 | Keegan, Sr. et al. | |
| 631,747 | A | * | 8/1899 | Lloyd | 5/122 |
| 817,534 | A | | 4/1906 | Troselj | |
| 1,185,568 | A | * | 5/1916 | Zeunert | 108/115 |
| 1,480,591 | A | | 1/1924 | Bakesef et al. | |
| 1,732,008 | A | | 10/1929 | Frantz | |
| 1,917,518 | A | * | 7/1933 | Goudie | 5/120 |
| 2,503,508 | A | * | 4/1950 | Parks | 297/440.11 |
| 3,086,740 | A | | 4/1963 | Hatton | |
| 3,593,352 | A | | 7/1971 | Britt | |
| 4,229,845 | A | | 10/1980 | de Cuadros | |
| 4,691,394 | A | | 9/1987 | Woo | |
| D295,242 | S | | 4/1988 | Frick et al. | |
| 4,757,563 | A | | 7/1988 | An | |
| 4,826,241 | A | | 5/1989 | Barras | |
| 4,925,138 | A | | 5/1990 | Rawlins | |
| 5,003,652 | A | | 4/1991 | Bayless | |
| 5,046,203 | A | | 9/1991 | de Cuadros | |

(Continued)

FOREIGN PATENT DOCUMENTS

| | | |
|---|---|---|
| IT | 697011 | 11/1972 |

(Continued)

OTHER PUBLICATIONS

Advertisement for the "Easy Foldable Hammock," 1 page.

(Continued)

*Primary Examiner*—Robert G. Santos
(74) *Attorney, Agent, or Firm*—Cooley Godward LLP

(57) ABSTRACT

An apparatus or support having a frame that can be disposed in an expanded configuration and a collapsed configuration. The frame includes a first end portion, a second end portion, a first side portion, a second side portion, and several connectors. Each of the connectors are disposable at a first position when the frame is in its expanded configuration and are disposable at a second position when the frame is in its collapsed configuration.

28 Claims, 13 Drawing Sheets

U.S. PATENT DOCUMENTS

| | | | | | |
|---|---|---|---|---|---|
| D342,841 | S | | 1/1994 | Campanello | |
| 5,392,476 | A | | 2/1995 | Williams | |
| 5,636,392 | A | | 6/1997 | Choi | |
| 5,655,235 | A | | 8/1997 | DeAth | |
| 5,659,907 | A | | 8/1997 | Huang | |
| 5,715,552 | A | | 2/1998 | DeAth | |
| 5,718,473 | A | | 2/1998 | Lynch, Jr. | |
| 5,740,570 | A | | 4/1998 | Hsieh | |
| D408,166 | S | | 4/1999 | Bayless | |
| 5,983,422 | A | | 11/1999 | Bayless | |
| 5,984,406 | A | * | 11/1999 | Lee | 297/16.2 |
| 6,082,813 | A | * | 7/2000 | Chen | 297/16.2 |
| 6,112,757 | A | * | 9/2000 | Tseng | 135/145 |
| 6,170,907 | B1 | * | 1/2001 | Tsai | 297/16.1 |
| 6,276,008 | B1 | | 8/2001 | Chen | |
| 6,418,577 | B1 | | 7/2002 | Murphy | |
| 6,454,348 | B1 | * | 9/2002 | Wu | 297/16.2 |
| 6,467,109 | B1 | | 10/2002 | Wu | |
| D498,088 | S | * | 11/2004 | Tsang | D6/484 |
| 2005/0060802 | A1 | * | 3/2005 | Zhong | 5/120 |

FOREIGN PATENT DOCUMENTS

| | | |
|---|---|---|
| WO | 86/05081 | 9/1986 |

OTHER PUBLICATIONS

Advertisement for the “Folding Hammock-Padded Reversible” and the “Heavenly Slumber Hammock,”1 page.

Advertisement for the “Hide-Away Hammock”, 1 page.

* cited by examiner

FIG. 5
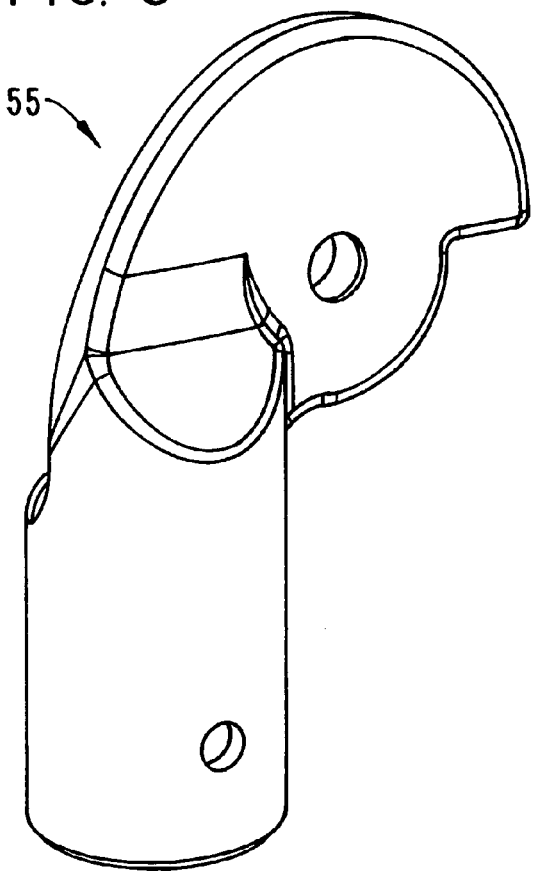
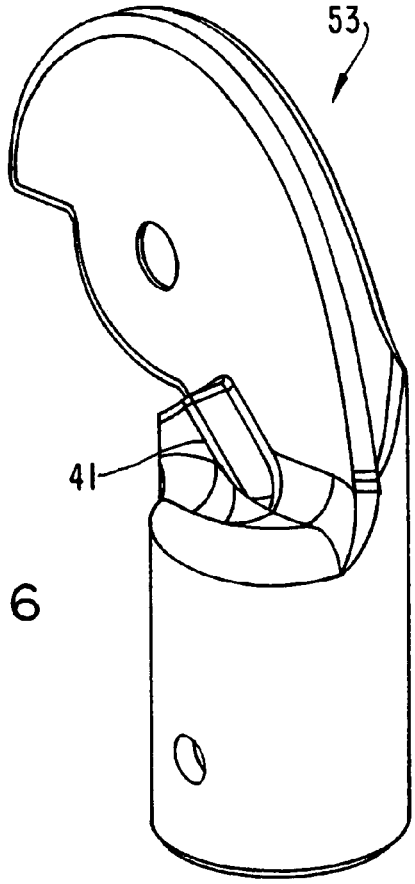
FIG. 6

FIG. 7
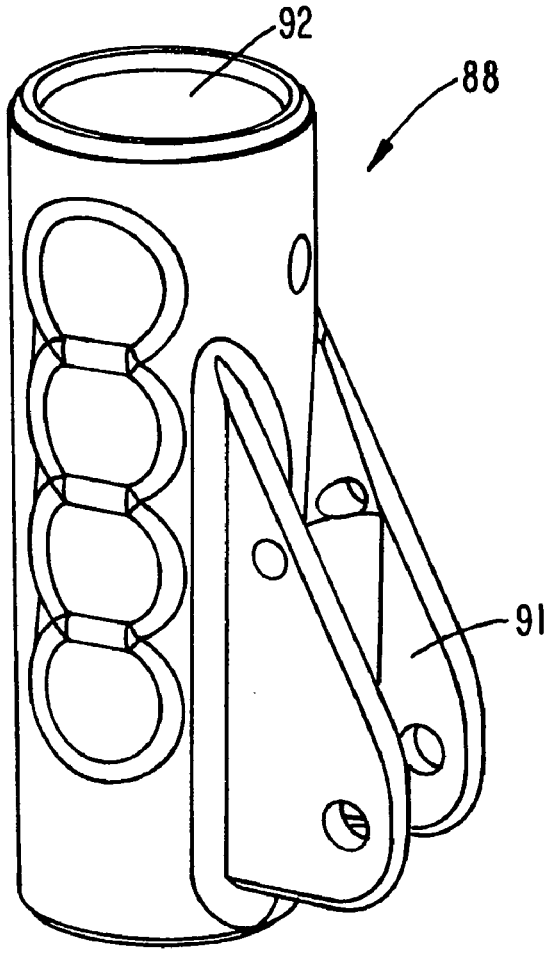
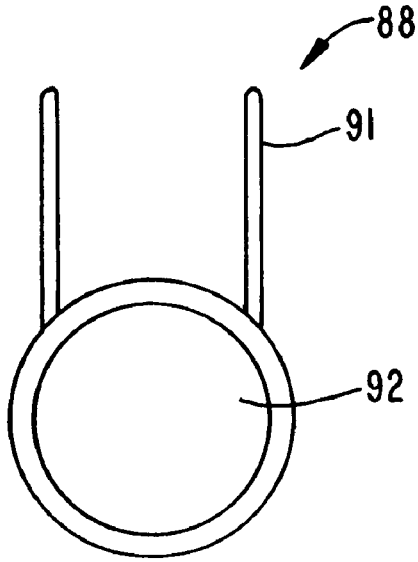
FIG. 8

SUPPORT AND METHOD OF USING THE SAME

BACKGROUND OF THE INVENTION

This invention relates generally to a support having multiple configurations, and in particular, to a support, such as a hammock support, that can be disposed in an expanded configuration and in a collapsed configuration.

Conventional hammocks and hammock supports can be used to support a user. Such hammocks and hammock supports are often transported and used in various outdoor settings, such as in a backyard or at a campground. Conventional hammocks and hammock supports, however, are difficult to transport because of their size and weight.

A need, therefore, exists for a hammock and hammock support that can be easily converted from an expanded configuration to a collapsed configuration and easily transported from one location to another.

SUMMARY OF THE INVENTION

An apparatus or support includes a frame that can be disposed in an expanded configuration and in a collapsed configuration. The frame is self-supporting when disposed in its expanded configuration. The frame has a first end portion, a second end portion, a first side portion, a second side portion, and several connectors. Each connector is coupled to one of the side portions. Additionally, each connector is disposable at a first position on one of the end portions when the frame is in its expanded configuration and is disposable at a second position on the one end portion when the frame is in its collapsed configuration.

BRIEF DESCRIPTION OF THE DRAWINGS

FIGS. 5 and 6 are perspective views of the first and second connection portions, respectively, of the coupler illustrated in FIGS. 3 and 4.

FIGS. 7 and 8 are a perspective view and an end view, respectively, of a connector of the support illustrated in FIG. 1.

DETAILED DESCRIPTION OF THE INVENTION

An apparatus or support includes a frame that can be disposed in an expanded configuration and in a collapsed configuration. The frame is self-supporting when disposed in its expanded configuration. The frame has a first end portion, a second end portion, a first side portion, a second side portion, and several connectors. Each connector is coupled to one of the side portions. Additionally, each connector is disposable at a first position on one of the end portions when the frame is in its expanded configuration and is disposable at a second position on the one end portion when the frame is in its collapsed configuration.

Figure 1:
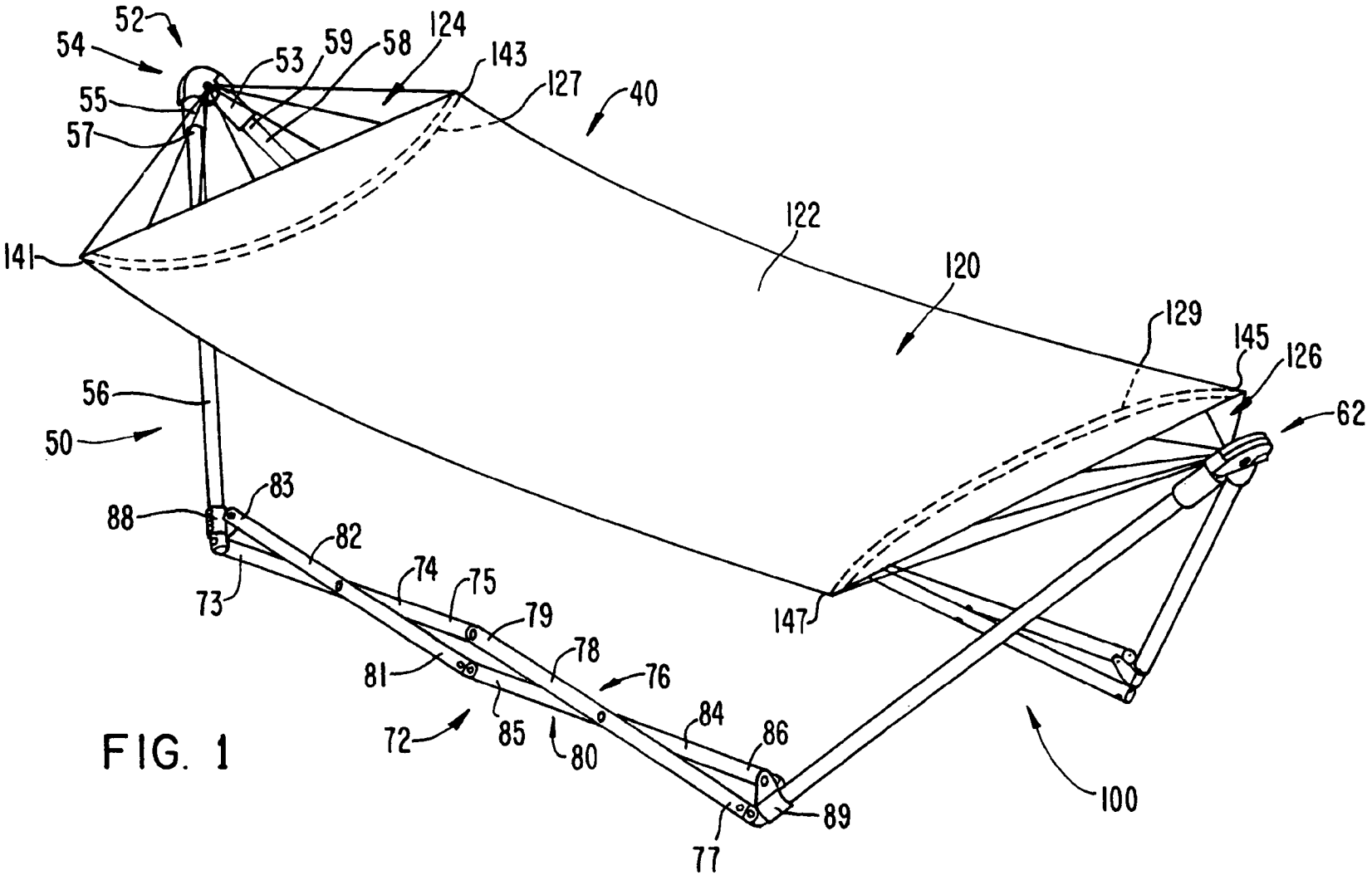
FIG. 1 is perspective view of a support according to an embodiment of the disclosed invention disposed in an expanded configuration.
Figure 2:
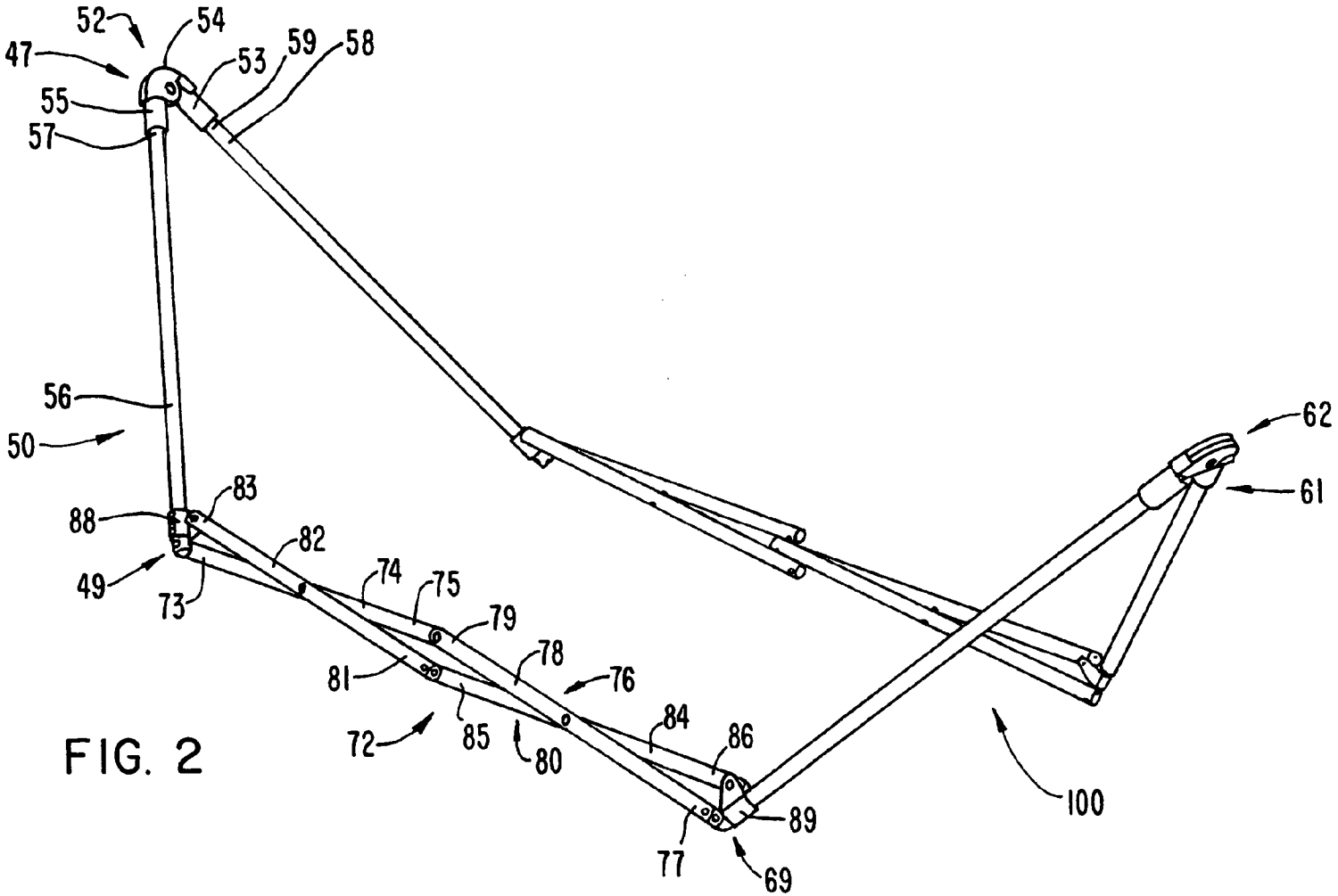
FIG. 2 is a perspective view of a frame of the support illustrated FIG. 1 disposed in an expanded configuration.
Figure 3:
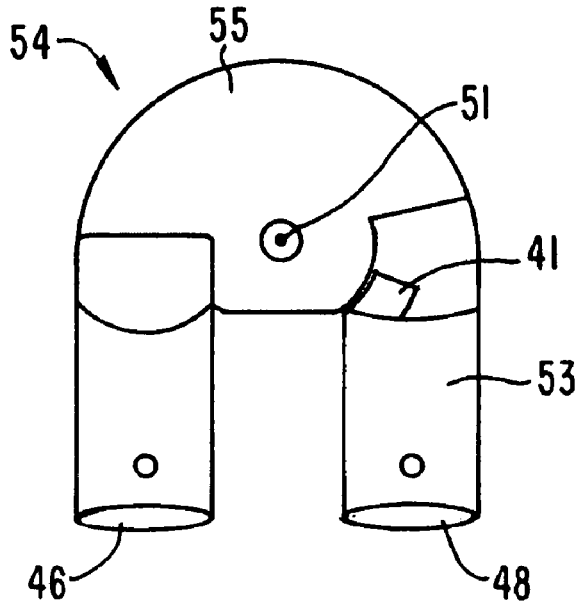
FIGS. 3 and 4 are top views of a coupler of the support illustrated in FIG. 1.

An apparatus according to an embodiment of the invention is illustrated in FIGS. 1–11. FIGS. 1 and 2 illustrate the apparatus or support 40 in an expanded or deployed configuration. In one embodiment, the support 40 in its expanded configuration can be used as a hammock (also referred to herein as a "hammock member").

In the illustrated embodiment, the support 40 includes a frame 50 and a hammock member 120 coupled to the frame. The frame 50 has a first end portion 52 and a second end portion 62, which are coupled together by a first side portion 72 and a second side portion 100.

In the illustrated embodiment, the first end portion 52 of the frame 50 and the second end portion 62 of the frame are mirror images of each other and include similar components. Thus, for simplicity, only the first end portion 52 will be discussed in detail.

In the illustrated embodiment, the first end portion 52 includes a first support member 56 and a second support member 58. The first support member 56 is coupled to the second support member such that the first support member pivots, or moves, with respect to the second support member from an open position to a closed position. Specifically, a first end 57 of the first support member 56 is coupled to a coupler 54. Similarly, a first end 59 of the second support member 58 is coupled to the coupler 54.

As illustrated in FIGS. 3–6, the coupler 54 includes a first connection portion 55 and a second connection portion 53. The first connection portion 55 is coupled to the first end 57 of the first support member 56. The second connection portion 53 is coupled to the first end 59 of the second support member 58. The first connection portion 55 and the second connection portion 53 are pivotally coupled via any conventional means, such as a nut and bolt, a pin, a rivet, or a brad. Therefore, the coupler 54 is configured to bend or pivot about an axis 51, thereby allowing the first support member 56 to pivot or move with respect to the second support member 58.

Figure 4:
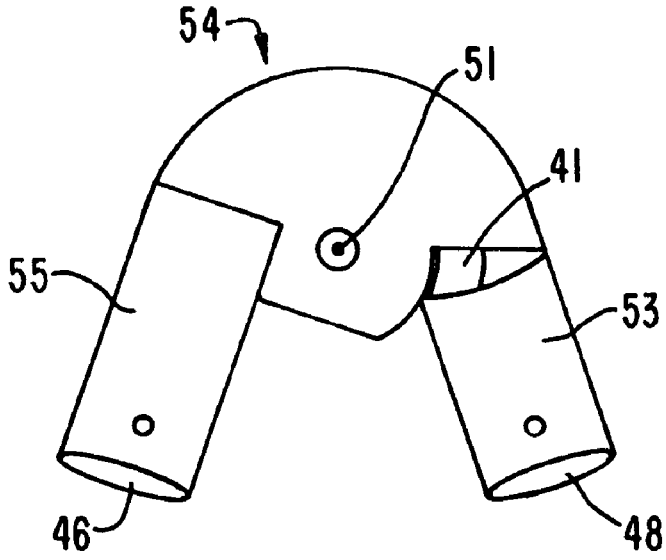

In the illustrated embodiment, the second connection portion 53 of the coupler 54 includes a protrusion 41. The protrusion 41 is sized such that the first support member 56 and the second support member 58 are prevented from over-pivoting with respect to each other. For example, as the first support member 56 is pivoted away from the second support member 58, the protrusion 41 moves toward the first connection portion 55 of the coupler 54. As best illustrated in FIG. 4, the protrusion 41 contacts the first connection portion 55 when the first support member 56 and the second support member 58 are pivoted with respect to each other to an open position. The contact between the protrusion 41 and the first connection portion 55 prevents the first support member 56 and the second support member 58 from being pivoted or moved beyond the open position.

In other embodiments, the coupler 54 includes several protrusions. For example, in one embodiment, the first connection portion and the second connection portion may include protrusions that are sized to contact another portion of the coupler when the support members 56 and 58 are pivoted to an open position.

In the illustrated embodiment, a portion of the first support member 56 and a portion of the second support member 58 are received by openings 46 and 48 of the coupler 54, respectively. In alternative embodiments, the support members are not received by the coupler 54.

In one embodiment, the support members 56 and 58 are coupled to the coupler 54 via an adhesive, such as glue. In alternative embodiments, the support members 56 and 58 are coupled to the coupler 54 via a screw, a rivet, a pin, or any other coupling mechanism. In a further alternative embodiment, the support members 56 and 58 are fit into the openings 46 and 48 of the coupler 54, respectively, and are retained via friction. Although the first support member 56 and the second support member 58 are illustrated as being coupled to the coupler 54 at their ends 57 and 59, respectively, the support members need not be coupled to the coupler at their ends.

In an alternative embodiment, the first end portion 52 of the frame 50 does not include a coupler 54. Rather, the first support member 56 is pivotally coupled to the second support member 58 via a rivet, a nut and bolt, a pin, or any other type of pivoting joint. In another alternative embodiment, the first support member 56 is fixedly coupled to the second support member 58, and the support members 56 and 58 are not configured to pivot with respect to each other.

In the illustrated embodiment, the first support member 56 and the second support member 58 are hollow, metal tubes, such as steel tubes. Alternatively, the support members 56 and 58 can be formed of any material and configured in any cross-sectional shape that provides sufficient structural strength to support a user. For example, the support members 56 and 58 can be aluminum tubes, plastic tubes, or solid metal or plastic bars.

In the illustrated embodiment, the first side portion 72 of the frame 50 and the second side portion 100 of the frame are mirror images of each other and include similar components. Thus, for simplicity, only the first side portion 72 will be discussed in detail. Although illustrated as such, however, the first side portion 72 and the second side portion 100 need not be mirror images of each other.

As best illustrated in FIGS. 1 and 2, the first side portion 72 includes a first support member 76 and a second support member 80. The first support member 76 has a first linkage 74, which is pivotally coupled to the first end portion 52 of the frame 50 at a first end 73, and a second linkage 78, which is pivotally coupled to the second end portion 62 of the frame 50 at a first end 77. The second end 75 of the first linkage 74 is pivotally coupled to the second end 79 of the second linkage 78.

In the illustrated embodiment, the first linkage 74 of the first support member 76 is pivotally coupled to the first end portion 52 of the frame 50 via a nut and bolt, a rivet, or a pin that extends through at least a portion of the first linkage and through at least a portion of the first end portion of the frame. The first linkage 74 is pivotally coupled to the second linkage 78 via a nut and bolt, a rivet, or a pin that extends through at least a portion of the first linkage and through at least a portion of the second linkage. The second linkage 78 is pivotally coupled to the second end portion 62 of the frame 50 via a nut and bolt, a rivet, or a pin that extends through at least a portion of the second linkage and through at least a portion of the second end portion of the frame.

In alternative embodiments, other connection mechanisms, such as brads, hinges, or any other type of pivoting joints, are used to couple the first linkage 74 to the first end portion 52 of the frame 50, to couple the first linkage 74 to the second linkage 78, and/or to couple the second linkage 78 to the second end portion 62 of the frame.

In the illustrated embodiment, the second support member 80 has a first linkage 82, a second linkage 84, and connectors 88 and 89. The first linkage 82 is pivotally coupled at a first end 81 to a first end 85 of the second linkage 84 via a nut and bolt, a rivet, or a pin that extends through at least a portion of the first linkage and through at least a portion of the second linkage. A second end 83 of the first linkage 82 is pivotally coupled to the connector 88 via a nut and bolt, a rivet, or a pin that extends through at least a portion of the first linkage and through at least a portion of the connector. Similarly, a second end 86 of the second linkage 84 is pivotally coupled to the connector 89 via a nut and bolt, a rivet, or a pin that extends through at least a portion of the second linkage and through at least a portion of the connector.

In alternative embodiments, other connection mechanisms, such as brads, hinges or any other type of pivoting joint, are used to couple the first linkage 82 to the second linkage 84, to couple the first linkage 82 to the connector 88, and/or to couple the second linkage to the connector 89.

In the illustrated embodiment, first support member 76 is pivotally coupled to the second support member 80. Specifically, the first linkage 74 of the first support member 76 is pivotally coupled to the first linkage 82 of the second support member 80, and the second linkage 78 of the first support member is pivotally coupled to the second linkage 84 of the second support member. However, in alternative embodiments, the first support member 76 is not coupled to the second support member 80.

In the illustrated embodiment, the first linkage 74 and the second linkage 78 of the first support member 76, and the first linkage 82 and the second linkage 84 of the second support member 80 are hollow, metal tubes, such as steel tubes. Alternatively, the linkages 74, 78, 82, and 84 can be formed of any material and configured in any cross-sectional shape that provides sufficient structural strength to support a user. For example, the linkages 74, 78, 82, and 84 can be aluminum tubes, plastic tubes, or solid metal or plastic bars.

In the illustrated embodiment, the connectors 88 and 89 are mirror images of each other and include similar components. Thus, for simplicity, only the connector 88 will be discussed in detail. Although illustrated as such, however, the connectors 88 and 89 need not be mirror images of each other.

The connector 88 is a device that can be pivotally coupled to the first linkage 82 of the second support member 80 and can be disposed at one of several positions on the first support member 56 of the first end portion 52. As illustrated in FIGS. 7 and 8, the connector 88 includes a coupling portion 91 for pivotally coupling the connecter to the first linkage 82 and an opening 92 through which the first support member 56 of the first end portion 52 extends. With the first support member 56 of the first end portion 52 extending through the opening 92 of the connector 88, the connector is slideably coupled to the first support member and can be slid with respect to the first support member from a first position on the first support member to a second position on the first support member.

In the illustrated embodiment, the opening 92 of the connector 88 is circular, and the cross-section of the first support member 56 of the first end portion 52 is circular. In alternative embodiments, however, the cross-sections of the opening 92 and of the support member 56 are of a shape other than circular, such as rectangular or triangular.

In an alternative embodiment, the connector 88, rather than an opening, includes a protrusion that engages a slot or a groove disposed on the first support member 56 of the first end portion 52 to slideably couple the connector to the first end portion. In another alternative embodiment, the connector 88, rather than having a closed loop structure, includes an open loop structure, such as a "C" shaped structure, that would allow the connector to be slideably coupled to the first support member 56 of the first end portion 52. In yet another alternative embodiment, the connector 88 includes a clip type mechanism, or any other mechanism, that would allow the connector to be removably coupled to the first support member 56 at a first position and at a second position.

As illustrated in FIGS. 1 and 2, the connectors 88 and 89 and the connectors of the second side portion 100 are disposed in a first or low position on the end portions 52 and 62 when the frame 50 is disposed in its expanded configuration. For example, connector 88 is disposed at a low position on the first support member 56 of the first end portion 52, which is proximate to the first end 73 of the first linkage 74 of the first side portion 76, when the frame 50 is disposed in its expanded configuration.

In the illustrated embodiment, the first support member 76 of the first side portion 72 and the second support member 80 of the first side portion are configured such that when the frame is in its expanded configuration the corresponding linkages of the first support member and the second support member are substantially parallel (or they are closer to being parallel than they are to being perpendicular) to each other. Specifically, the first linkage 74 of the first support member 76 is substantially parallel to the first linkage 82 of the second support member 80, and the second linkage 78 of the first support member is substantially parallel to the second linkage 84 of the second support member.

As best illustrated in FIG. 2, when the frame 50 is disposed in its expanded configuration, the first end portion 52 and the second end portion 62 are slanted with respect to each other. In other words, the first end portion 52 and the second end portion 62 are not disposed in a parallel relationship when the frame is disposed in its expanded configuration. In the illustrated embodiment, the distance between a first end 47 of the first end portion 52 and a first end 61 of the second end portion 62 is greater than the distance between a second end 49 of the first end portion and a second end 69 of the second end portion. Additionally, when the frame 50 is in its expanded configuration, the support members 56 and 58 of the first end portion 52 are pivoted or moved apart from each other in an open position.

The frame 50 remains in its expanded configuration when it is placed in such configuration. The forces that act on the frame when the connectors 88 and 89 of the first side portion 72 and the connectors of the second side portion 100 are in their lowered positions retain the connectors in their low positions. This allows the frame 50 to remain in its expanded configuration. Specifically, when the connectors 88 and 89 of the first side portion 72 and the connectors of the second side portion 100 are in their lowered positions, the side support members that are coupled to the connectors create a force that tends to force the end portions 52 and 62 away from one another. Conversely, the side support members that are pivotally coupled to the end portions 52 and 62 create a force that tends to force the lower portions of the end portions towards each other when the connectors 88 and 89 of the first side portion 72 and the connectors of the second side portion 100 are in their lowered positions.

In an alternative embodiment, the connectors 88 and 89 of the first side portion 72 and the connectors of the second side portion 100 include a detent mechanism, such as a removable pin, or another locking type mechanism to retain the connectors in their lowered positions on the end portions 52 and 62.

Figure 9:
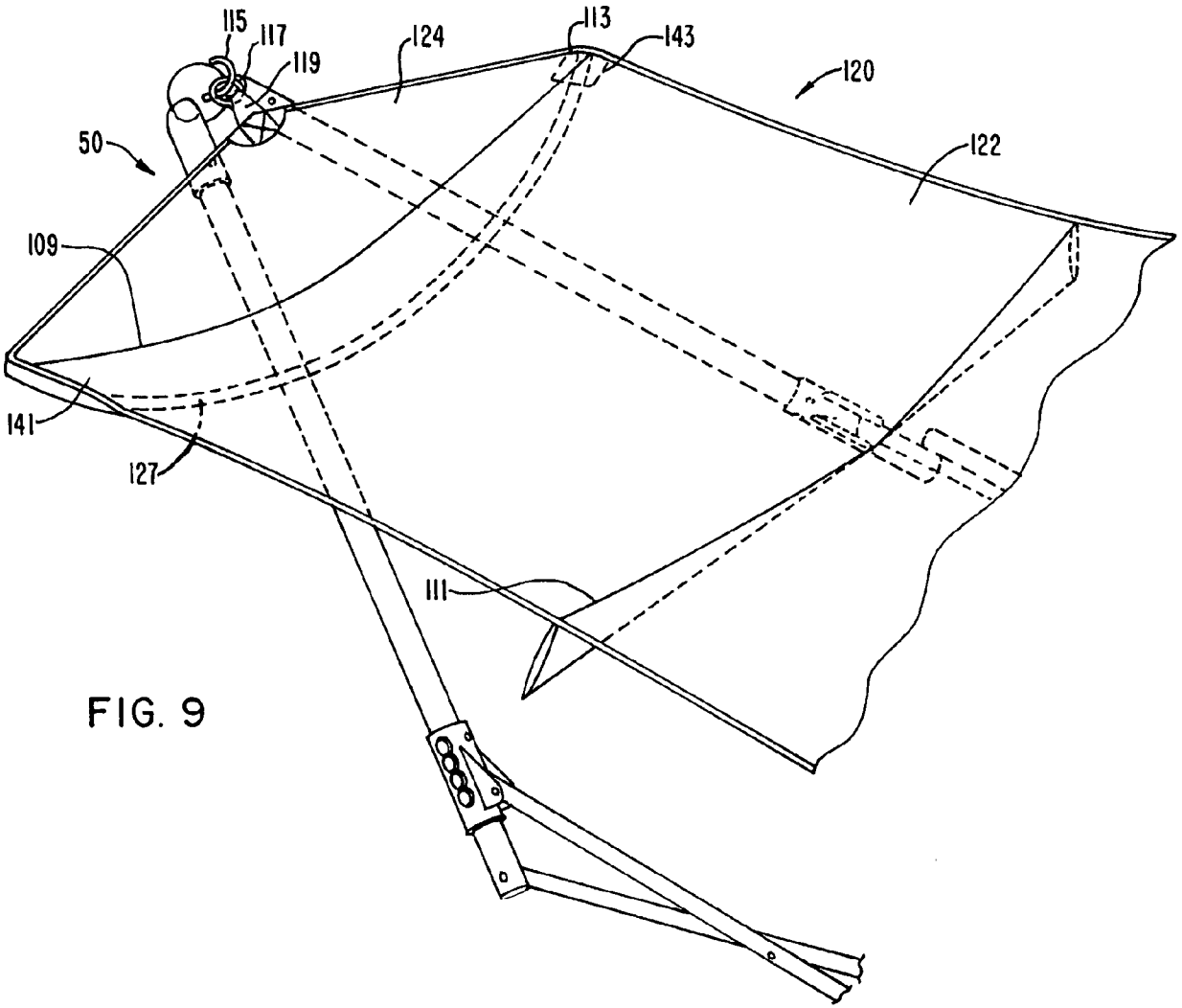
FIG. 9 is a perspective view of a portion of the support illustrated in FIG. 1.

The hammock member 120 of the support 40 is coupled to the end portions 52 and 62 of the frame 50, and is suspended between the end portions when the frame is in its expanded configuration. When the hammock member 120 is suspended between the end portion 52 and 62 of the frame 50, the hammock member is configured to receive and support a user. As best illustrated in FIGS. 1 and 9, the hammock member 120 includes a membrane portion 122 and coupling portions 124 and 126.

In the illustrated embodiment, each of the coupling portions 124 and 126 has a coupling strap 119, which is coupled to a respective coupling ring 117 (only coupling portion 124 is illustrated in detail). The coupling strap 119 is threaded through the coupling ring 117 and both ends of the coupling strap are coupled to the hammock member 120. In alternative embodiments, other mechanisms, such as a hook-and-loop type mechanism, is used to couple the coupling strap 119 to the hammock member 120.

In the illustrated embodiment, the coupling ring 117 interacts with a hook 115, which is coupled to the end portion 52 of the frame 50, to removably couple the hammock member 120 to the frame. In an alternative embodiment, the coupling ring 117 interacts with another portion of the frame 50 to removably or permanently couple the hammock member 120 to the frame.

In alternative embodiments, the coupling portions 124 and 126 of the hammock member 120 have coupling lines that are sewn to the membrane portion 122 and are removably tied to the end portions 52 and 62 of the frame 50. In another alternative embodiment, the coupling lines are tied to the membrane portion 122. In yet another alternative embodiments, the coupling lines are coupled to the membrane portion 122 via glue, staples, or any other known coupling mechanism. In further alternative embodiments, the coupling lines are coupled to the end portions 52 and 62 of the frame 50, respectively, via a clip, a hook, a snap, or any other known coupling mechanism. In a further alternative embodiment, the coupling portions 124 and 126 do not include coupling lines and the membrane portion 122 and the coupling portions are a single continuous piece of material. In yet a further alternative embodiment, the membrane portion 122 includes grommets, which interact with the hooks to removably couple the hammock member 120 to the frame 50.

As best illustrated in FIGS. 1 and 9, the hammock member 120 also includes support members 127 and 129. The support members 127 and 129 provide support to the hammock member 120. Specifically, the support members 127 and 129 retain the hammock member 120 in a spread or open configuration. Support member 127 is coupled to, and extends between, corners 141 and 143 of the hammock member 120. Similarly, support member 129 is coupled to, and extends between, corners 145 and 147 of the hammock member 120. In the illustrated embodiment, the support members 127 and 129 are coupled to the underside of the hammock member 120 and are of a bent or a non-linear configuration. Thus, in the illustrated embodiment, the ends of the support members 127 and 129 contact the hammock member 120 while the mid-portions of the support members do not contact the hammock member 120. At the centers of the support members 127 and 129, the support members can be, for example, approximately 2 to 6 inches below the hammock member 120.

In one embodiment, pockets 113 (only one is illustrated) are disposed on the underside of the hammock member 120, and receive and couple the ends of the support members 127 and 129 to the hammock member. In other embodiments, other conventional means, such as sewing or hook-and-loop type mechanisms, are used to removably or permanently couple the support members 127 and 129 to the hammock member 120.

In the illustrated embodiment, the support members 127 and 129 are hollow, metal tubes, such as steel tubes. Alternatively, the support members 127 and 129 can be formed of any material and configured in any cross-sectional shape that provides sufficient structural strength to retain the hammock member 120 in a spread or open configuration. For example, the support member 127 and 129 can be aluminum tubes, plastic tubes, solid metal or plastic bars, or wooden bars.

As best illustrated in FIG. 9, in the illustrated embodiment, the hammock member 120 is darted at several regions, including a middle region 111, a top region 109, and a bottom region (not illustrated). At the darted regions 111 and 109, the material of the membrane portion 122 is collected near the edges of the membrane portion and sewn. Thus, the center of the hammock member 120 includes more fabric than the edges of the hammock member, allowing hammock member have a cup-like form to receive a user.

In one embodiment, the membrane portion 122 is a layer of material, such as a layer of nylon or neoprene, or any other material of sufficient strength to support a user. In an alternative embodiment, the membrane portion 122 is several pieces of material that form a mesh.

Figure 10:
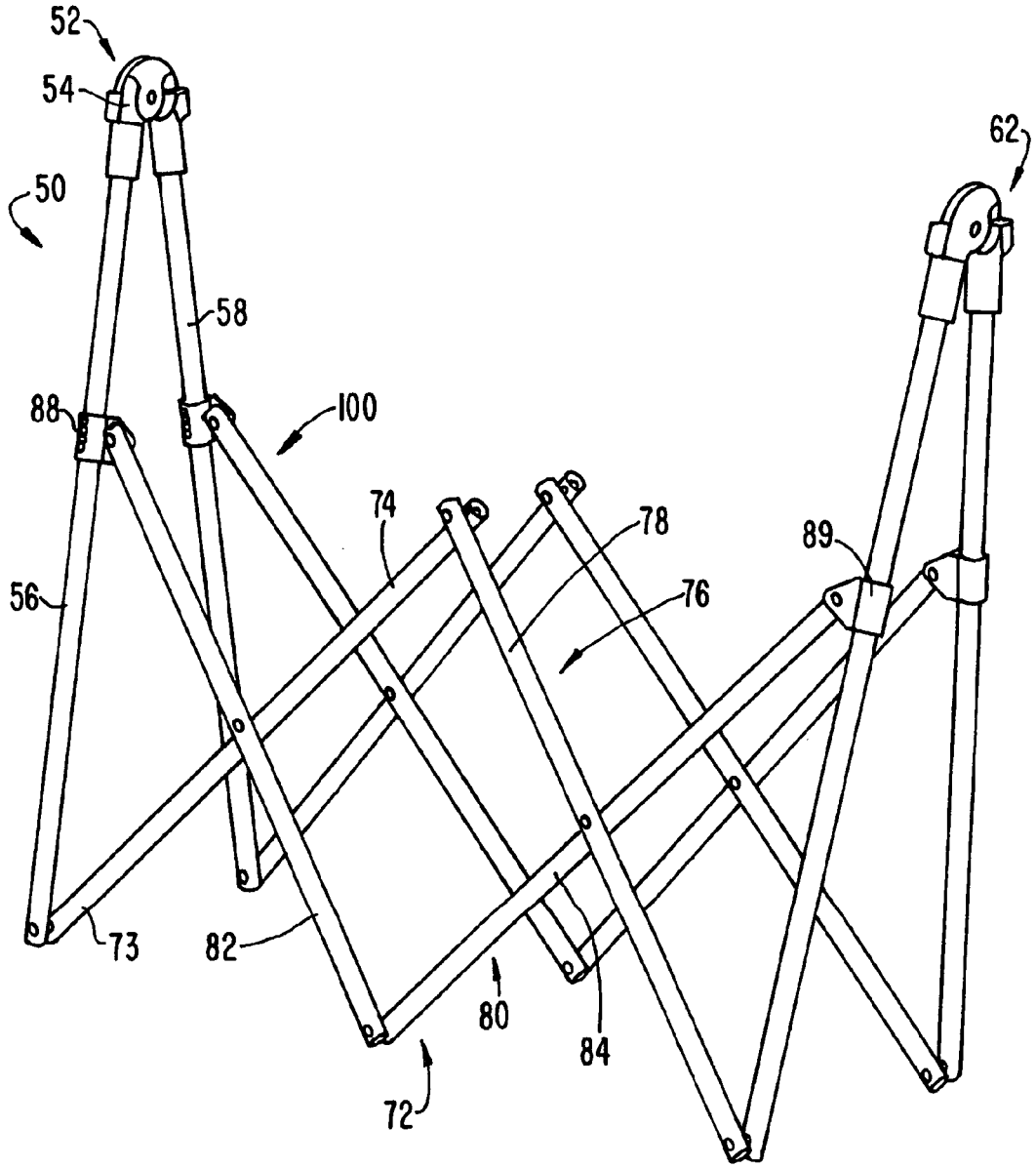
FIGS. 10 and 11 are perspective views of the frame of the support illustrated in FIG. 1 disposed in collapsed configurations.
Figure 11:
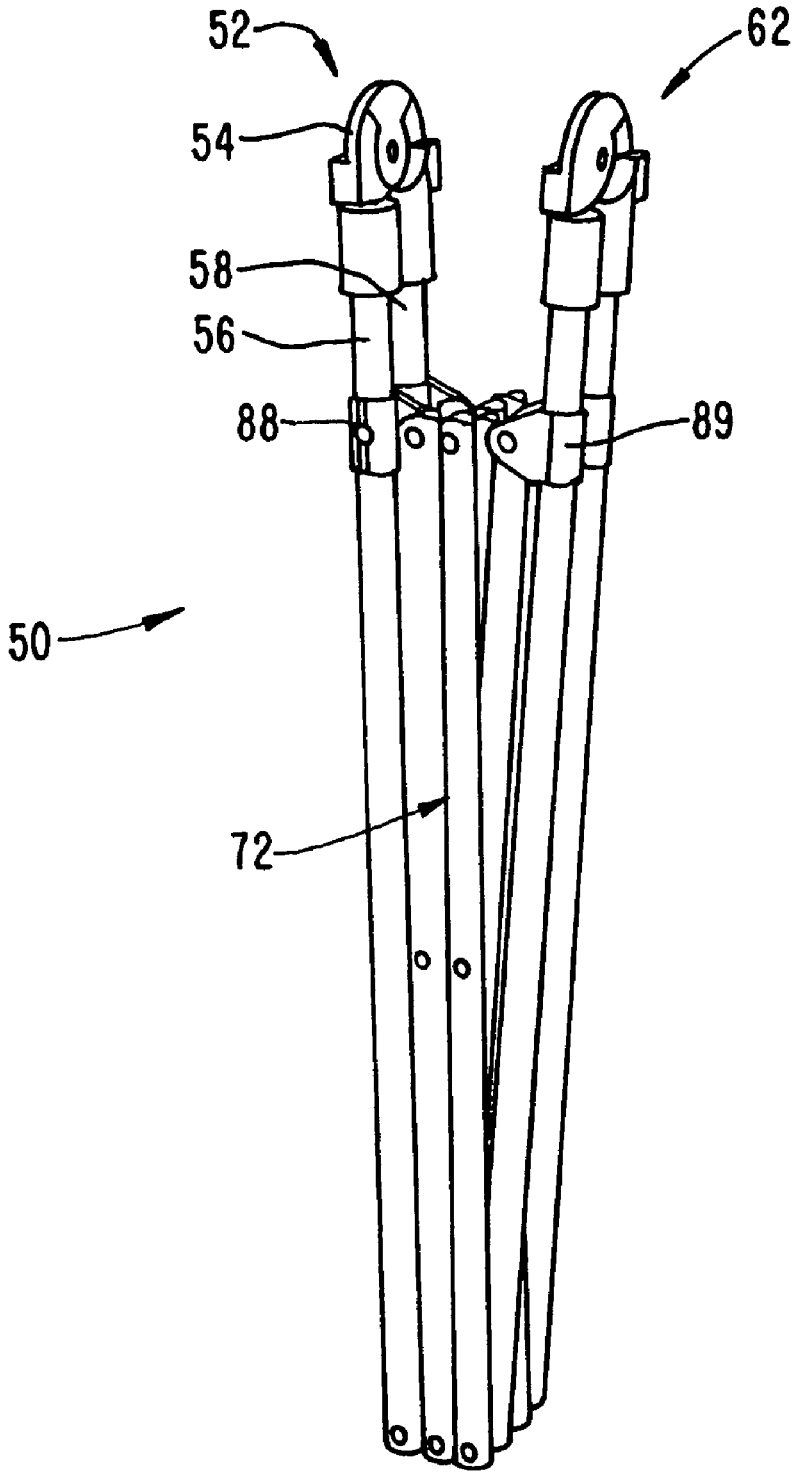

As illustrated in FIGS. 10 and 11, the frame 50 may be converted from an expanded configuration to a collapsed configuration. To convert the frame 50 from its expanded configuration to its collapsed configuration, the connectors 88 and 89 of the first side portion 72 and the connectors of the second side portion 100 are moved with respect to the end portions 52 and 62 from their first or low positions to their second or high positions. For example, connector 88 is slid in a direction toward the coupler 54 on the first support member 56 from a position proximate to the first end 73 of the first linkage 74 of the first side portion 76 to a high position proximate to the coupler.

The movement of the connectors 88 and 89 of the first side portion 72 and the connectors of the second side portion 100 toward their second positions causes the linkages of the side portions to be pivoted with respect to each other. For example, when the connector 88 is slid or moved towards the coupler 54 and connector 89 is similarly slid or moved, the first linkage 74 of the first support member 76 of the first side portion 72 pivots with respect to the second linkage 78 of the first support member and also pivots with respect to the first support member 56 of the first end portion 52. Similarly, the second linkage 78 pivots with respect to the second end portion 62. Additionally, the first linkage 82 of the second support member 80 of the first side portion 72 pivots with respect to the second linkage 84 of the second support member 80 when the connector 88 is slid or moved towards the coupler 54 and connector 89 is similarly slid or moved. The pivoting of the linkages 74, 78, 82, and 84 causes the first end portion 52 to be moved towards the second end portion 62.

As illustrated in FIGS. 5 and 6, when the frame 50 is in its collapsed configuration the support members of the end portions may be pivoted with respect to each other to a closed position. For example, the first support member 56 of the first end portion 52 may be pivoted towards the second support member 58.

Figure 12:
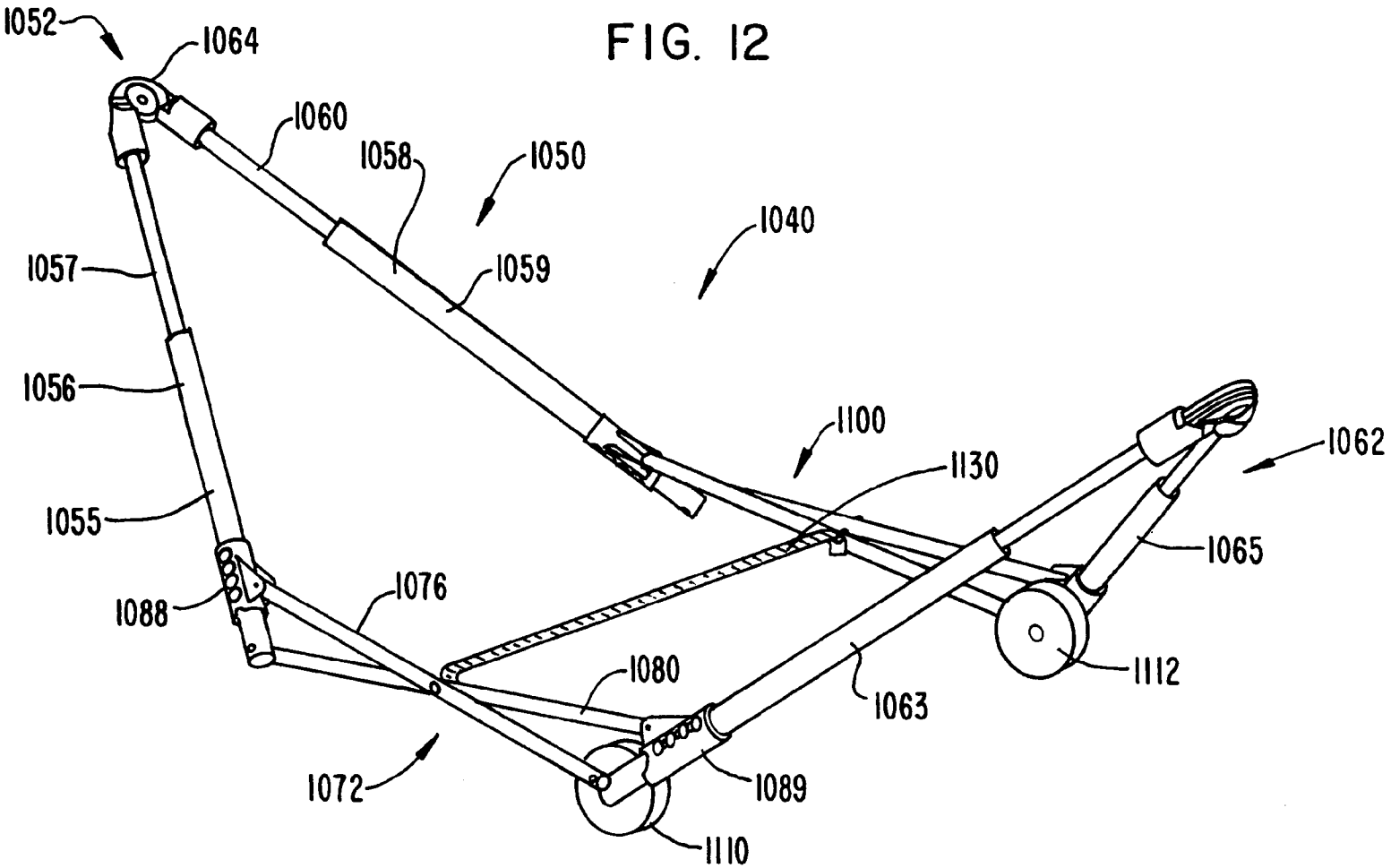
FIGS. 12–16 are perspective views of supports according to other embodiments of the disclosed invention.

An alternative embodiment of the apparatus is illustrated in FIG. 12. As illustrated, apparatus or support 1040 includes a frame 1050, wheels 1110 and 1112 that are coupled to the frame, and a support strap 1130 that is coupled to the frame. The frame 1050 can be disposed in an expanded configuration and in a collapsed configuration, and has a first end portion 1052, a second end portion 1062, a first side portion 1072, and a second side portion 1100.

In the illustrated embodiment, the first end portion 1052 of the frame 1050 and the second end portion 1062 of the frame are mirror images of each other. Thus, for simplicity, only the first end portion 1052 will be discussed in detail. However, although illustrated as such, the end portions 1052 and 1062 need not be mirror images of each other.

In the illustrated embodiment, the first end portion 1052 includes a first support member 1056 and a second support member 1058. The first support member 1056 has an extended configuration and a contracted configuration. The first support member 1056 includes a first linkage 1057 that is slideably coupled to a second linkage 1055. The first linkage 1057 of the first support member 1052 is sized such that it slides within a cavity of the second linkage 1055. This "telescoping" arrangement between the first linkage 1057 and the second linkage 1055 of the first support member 1056 allows the first support member to be placed in an extended, or lengthened, configuration and in a contracted, or shortened, configuration. When in the extended, or lengthened, configuration, the telescoping arrangement allows the frame of the support to fully extend to the intended height, thereby positioning the hammock member sufficiently above the support surface (e.g., the ground). When in the contracted, or shortened configuration the telescoping arrangement allows for compact transportation of the support.

In one embodiment, the first linkage 1057 and the second linkage 1055 are sized such that the frictional force between the linkages retains the linkages in position with respect to each other. In an alternative embodiment, the first support member 1056 includes a mechanism such as a detent, a pin, or any other locking mechanism to retain the linkages in position with respect to each other.

Similar to the first support member 1056, in the illustrated embodiment, second support member 1058 of the first end portion 1052 has an extended configuration and a contracted configuration. The second support member 1058 includes a first linkage 1060 that is slideably coupled to a second linkage 1059. The first linkage 1060 of the second support member 1058 is sized such that it slides within a cavity of the second linkage 1059. This "telescoping" arrangement between the first linkage 1060 and the second linkage 1059 of the second support member 1058 allows the second support member to be placed in an extended, or lengthened, configuration and in a contracted, or shortened, configuration.

In one embodiment, the first linkage 1060 and the second linkage 1059 are sized such that the frictional force between the linkages retains the linkages in position with respect to each other. In alternative embodiments, the second support member 1058 includes a mechanism such as a detent, a pin, or any other locking mechanism to retain the linkages in position with respect to each other.

The first end portion 1052 of the frame 50 also includes a coupler 1064 that pivotally couples the first support member 1056 of the second support member 1058.

In the illustrated embodiment, the first side portion 1072 of the frame 1050 and the second side portion 1100 of the frame are mirror images of each other. Thus, for simplicity, only the first side portion 1072 will be discussed in detail. However, although illustrated as such, the end portions 1072 and 1100 need not be mirror images of each other.

The first side portion 1072 of the frame 1050 includes a first support member 1076 and a second support member 1080. The first support member 1076 is pivotally coupled at a first end to a connector 1088 and is pivotally coupled at a second end to the second end portion 1062 of the frame 1050. The connector 1088 is slideably coupled to the first support member 1056 of the first end portion 1052 of the frame 1050 and is disposable at first position when the frame 1050 is disposed in its expanded configuration, and at a second position when the frame is disposed in its collapsed configuration.

Similar to the first support member 1076 of the first side portion 1072, the second support member 1080 is pivotally coupled at a first end to a connector 1089 and is pivotally coupled at a second end to the first end portion 1052 of the frame 1050. The connector 1089 is slideably coupled to a first support member 1063 of the second end portion 1062 of the frame 1050, and is disposable at first position when the frame 1050 is disposed in its expanded configuration and at a second position when the frame is disposed in its collapsed configuration.

In the illustrated embodiment, the first support member 1076 is pivotally coupled to the second support member 1080. However, in alternative embodiments, the first support member 1076 is not coupled to the second support member 1080.

It should be understood by one skilled in the art that the support 1040 can be converted from an expanded configuration to a collapsed configuration in a manner similar to that described above for support 40.

The wheels 1110 and 1112 of the support 1040 are rotatably coupled to the second end portion 1062 of the frame 1050. The wheels 1110 and 1112 are configured to roll along a support surface to transport the support 1040 when the frame 1050 is disposed in its expanded configuration and/or its collapsed configuration. In one embodiment, the wheels 1110 and 1112 have locking mechanisms (not shown) to lock the wheels so as to prevent them from rotating. In the illustrated embodiment, the wheel 1110 is coupled to the first support member 1063 of the second end portion 1062, and the wheel 1112 is coupled to a second support member 1065 of the second end portion. In alternative embodiments, however, the wheels 1110 and 1112 are coupled to different portions of the support 1040, such as to the side portions 1072 and 1100 or to the first end portion 1052.

In the illustrated embodiment, the support strap 1130 of the support 1040 is coupled to, and extends between, the first side portion 1072 of the frame 1050 and the second side portion 1100 of the frame. The support strap 1130 provides support to the frame 1050 when the frame is in its expanded configuration. Specifically, the support strap 1130 is configured to prevent the first side portion 1072 from bowing away from the second side portion 1100 when the frame 1150 is disposed in its expanded configuration. Although only one support strap 1130 is illustrated, the support 1040 may include any number of support straps. In some embodiments, the support strap is not necessary, particularly where the support members are sufficiently rigid.

Figure 13:
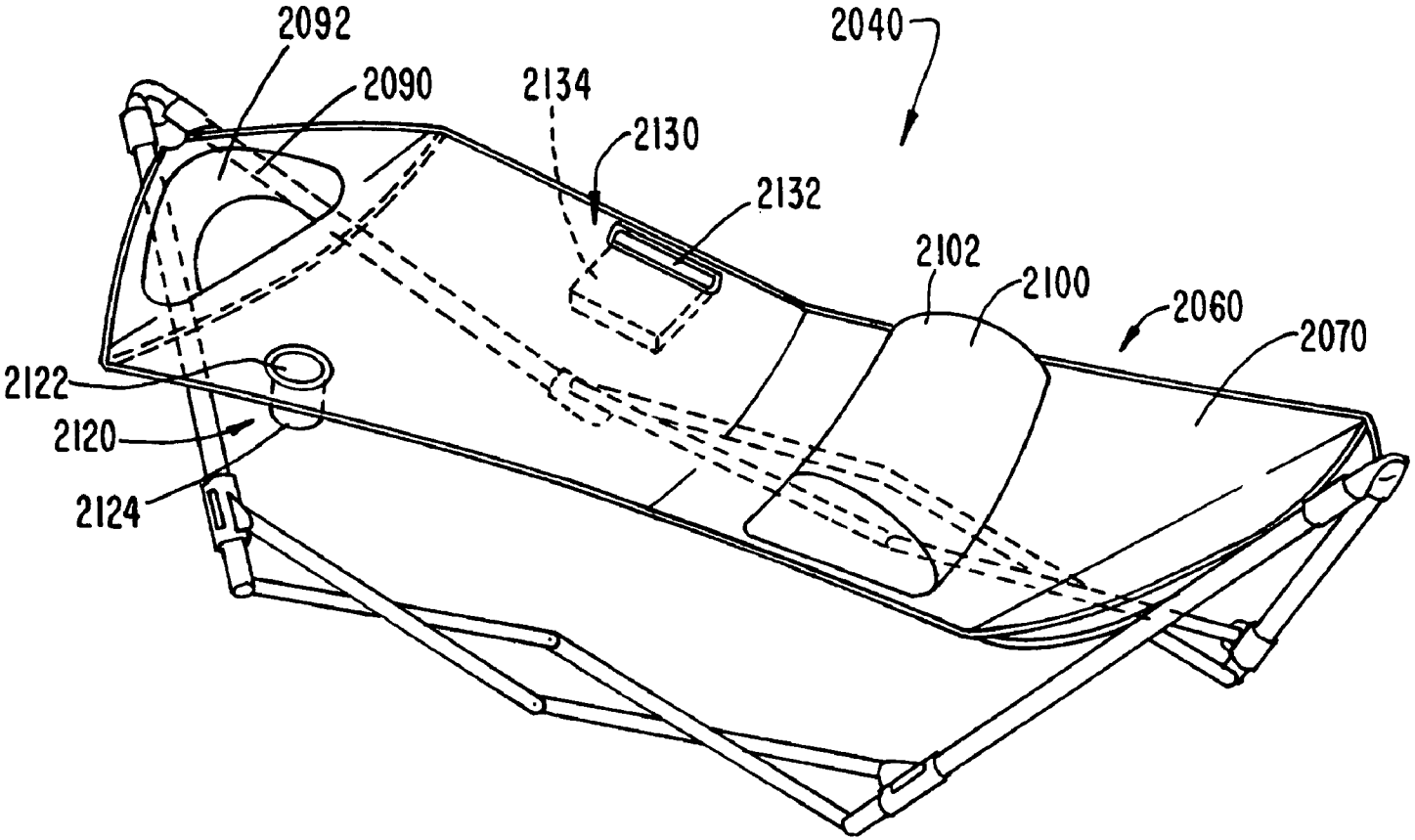

An alternative embodiment of the apparatus is illustrated in FIG. 13. The apparatus or support 2040 includes a hammock member 2060 that has a membrane portion 2070, a head pillow 2090, and a leg pillow 2100.

In the illustrated embodiment, the head pillow 2090 is disposable at a position to support the head or neck of a user. In one embodiment, the head pillow 2090 includes an outer shell 2092 and filling material disposed within the shell. In an alternative embodiment, the head pillow is an inflatable pillow.

In one embodiment, one, or both, of the outer shell 2092 and the hammock member 2060 include a coupling mechanism that allows the head pillow 2090 to be removably coupled to the hammock member. For example, the outer shell 2092 and the hammock member 2060 my include a hook-and-loop type coupling mechanism, a snap type coupling mechanism, or any other type of non-permanent coupling mechanism. In an alternative embodiment, the head pillow 2090 is fixedly and permanently coupled to the hammock member 2060.

Similar to the head pillow 2090, in the illustrated embodiment, the leg pillow 2100 is disposable at a position to support the legs of a user. In one embodiment, the leg pillow 2100 includes an outer shell 2102 and filling material disposed within the shell. In an alternative embodiment, the leg pillow is an inflatable pillow.

In one embodiment, one, or both, of the outer shell 2102 and the hammock member 2060 include a coupling mechanism that allows the leg pillow 2100 to be removably coupled to the hammock member. For example, the outer shell 2102 and the hammock member 2060 my include a hook-and-loop type coupling mechanism, a snap type coupling mechanism, or any other type of non-permanent coupling mechanism. In an alternative embodiment, the leg pillow 2100 is fixedly and permanently coupled to the hammock member 2060.

The hammock member 2060 of the support 2040 also includes a beverage pocket 2120 and a book pocket 2130. The beverage pocket 2120 includes an opening 2122 in the hammock member 2060 and a receiver portion 2124 that is disposed adjacent to, and communicates with, the opening in the hammock member. The receiver portion 2124 includes a lower support portion (not illustrated). Thus, a beverage container may be placed in, and supported by, the beverage pocket 2120.

In one embodiment, the receiver portion 2124 is sewn to the hammock member 2060. In alternative embodiments, the receiver portion 2124 is coupled to the hammock member 2060 via another coupling mechanism, such as a hook-and-loop type mechanism.

In one embodiment, the receiver portion 2124 of the beverage pocket 2120 is made of a single piece of fabric or any other material that would provide the enough strength to support a beverage container. In another embodiment, the receiver portion 2124 of the beverage pocket 2120 is made of a several pieces of material.

The book pocket 2130 of the hammock member 2060 includes an opening 2132 in the hammock member 2060 and a receiver portion 2134 that is disposed adjacent to, and communicates with, the opening in the hammock member. The receiver portion 2134 includes a lower support portion (not illustrated). Thus, a book, a magazine, or other reading material may be placed in, and supported by, the book pocket 2130. In the illustrated embodiment, a lower support portion is coupled to the hammock member 2060. Thus, when a book or other reading material is placed in the book pocket 2130, the book or reading material is disposed in a parallel relationship to the hammock member 2060.

In one embodiment, the receiver portion 2134 is sewn to the hammock member 2060. In alternative embodiments, the receiver portion 2134 is coupled to the hammock member 2060 via another coupling mechanism, such as a hook-and-loop type mechanism.

In one embodiment, the receiver portion 2134 of the book pocket 2130 is made of a single piece of fabric or any other material that would provide the enough strength to support a book or other reading material. In another embodiment, the receiver portion 2134 of the book pocket 2130 is made of a several pieces of material.

Figure 14:
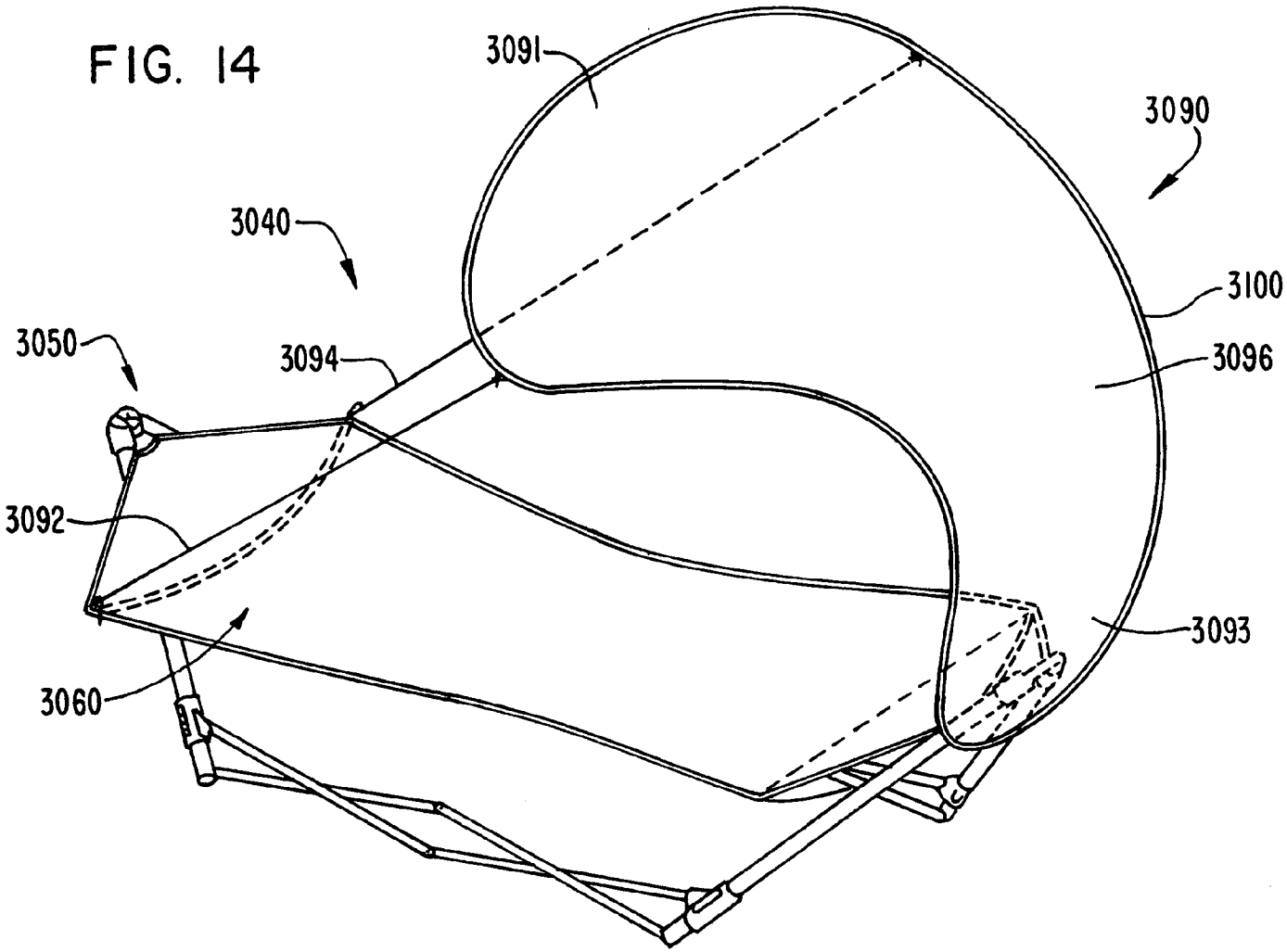

FIG. 14 illustrates another embodiment of an apparatus according to the disclosed invention. As illustrated, apparatus or support 3040 includes a shade member 3090. Shade member 3090 includes tethering lines 3092 and 3094, a membrane portion 3096, and a frame member 3100.

The tethering lines 3092 and 3094 are coupled to, and extend between a first end 3091 of the membrane portion 3096 and the hammock member 3060 of the support 3040. Conventional means, such as a releasable coupler, may be used to releasably couple the tethering lines 3092 and 3094 to the first end 3091 of the membrane portion 3096 and to the hammock member 3060. Alternatively, the first end 3091 of the membrane portion 3096 and the hammock member 3060 may include openings and the tethering lines 3092 and 3094 may be tied to the membrane portion and to the hammock portion. In a further alternative embodiment, the tethering lines 3092 and 3094 may be coupled to, and extend between, the frame portion 3050 of the support 3040 and the first end 3091 of the membrane portion 3096. In another embodiment, a single tethering line is used.

Any conventional means may be used to couple a second end 3093 of the membrane portion 3096 to the frame 3050 of the support 3040 and/or the hammock portion 3060 of the support. In one embodiment, a line or a clip mechanism is used to removably couple the second end 3093 of the membrane portion 3096 to the frame 3050 of the support 3040. Alternatively, the second end of the membrane portion can include a pocket (not illustrated in FIG. 14) into which an end of the frame can be removably inserted.

The membrane portion 3096 is coupled to the frame member 3100, which provides support for the shade member 3090. In the illustrated embodiment, the frame 3100 is a flexible band, such as a thin metal band. The shade member 3090 can be a collapsible and pop-open member having an extended configuration and a collapsed configuration. An example of a shade member is disclosed in U.S. patent application Ser. No. 09/764,059, entitled "Self-Opening Shades and Methods of Using the Same," filed on Jan. 19, 2001, the disclosure of which is incorporated by reference herein.

Figure 15:
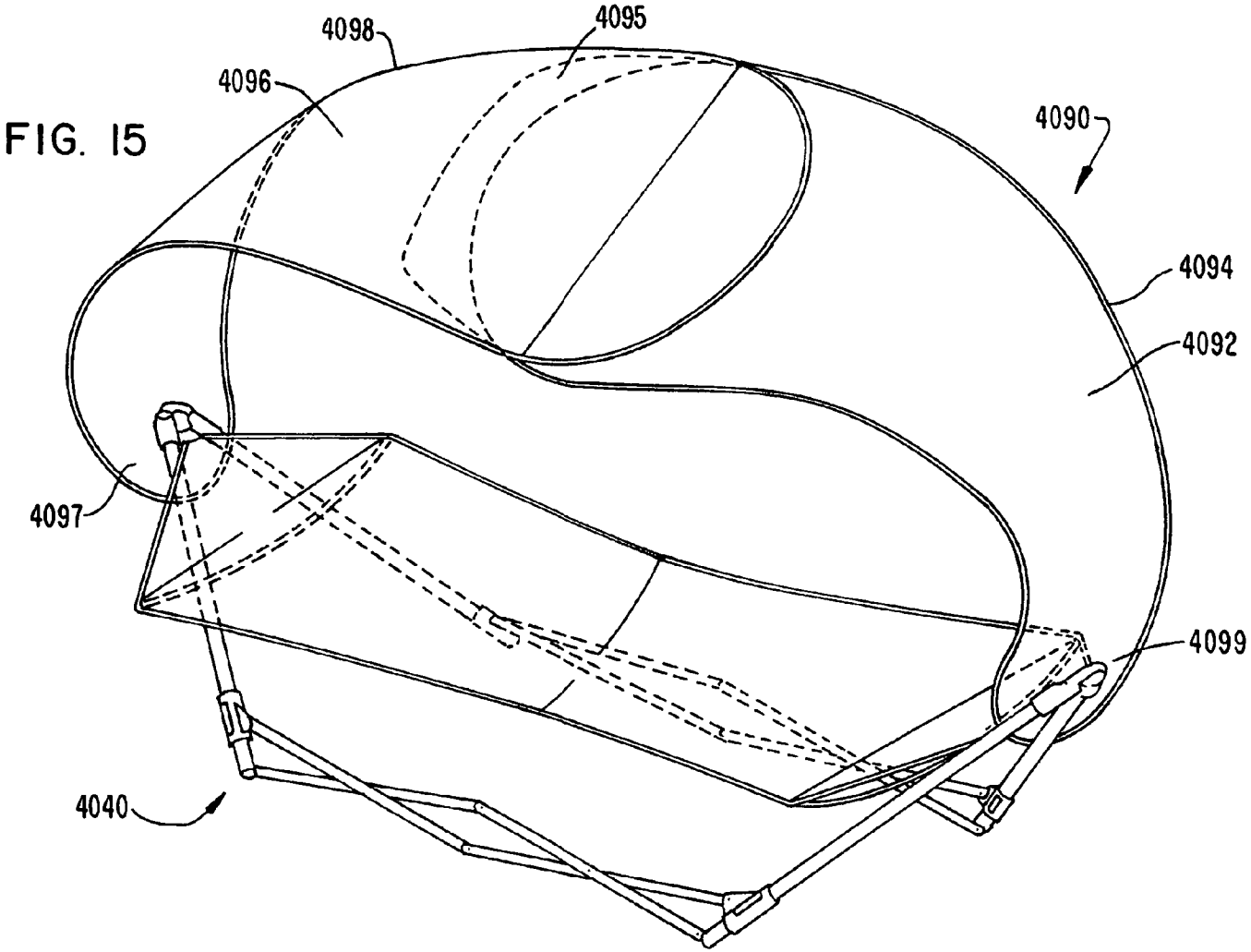

FIG. 15 illustrates an alternative embodiment of a shade member that may be used with an apparatus according to the disclosed invention. The shade member 4090 includes a first membrane portion 4092, a first frame 4094, a second membrane portion 4096, and a second frame portion 4098. The first membrane portion 4092 is coupled to the first frame member 4094, and the second membrane portion 4096 is coupled to the second frame member 4098. The first frame member 4094 and the second frame member 4098 provide support for the shade member 4090. In the illustrated embodiment, the first membrane portion 4092 and a portion of the first frame member 4094 are inserted into, and removably coupled to, a pocket 4095 disposed on the second membrane member 4096. In this embodiment the first member 4092 overlaps a portion of the second membrane 4094. In alternative embodiment, the first membrane portion 4092 does not overlap any portion of the second membrane portion 4096. In another alternative embodiment, both the second membrane portion and the first membrane portion include a pocket.

In an alternative embodiment, the membrane portions do not extend the entire length of the frames members. In such an embodiment, one end of each of the membrane portions is coupled to the frame of the support and the remaining end of one membrane portion is coupled to the remaining end of the other membrane portion. In this embodiment, when the shade is disposed on the support, the frame members extend beyond the coupling of the membrane portions. Additionally, when the shade is not disposed on the support, the shade can be collapsed by folding the shade along the coupling of the membrane portions prior and then by collapsing frame members.

In one embodiment, the first frame 4094 and the second frame 4098 are flexible bands, such as a thin metal bands.

In the illustrated embodiment, conventional means (not illustrated), such as a pocket, tethering lines, couplers, clips, or any other type of coupling mechanism, are used to removably couple a first end portion 4099 of the shade member 4090 to the support 4040 and to removably couple a second end portion 4097 of the shade member to the support.

Figure 16:
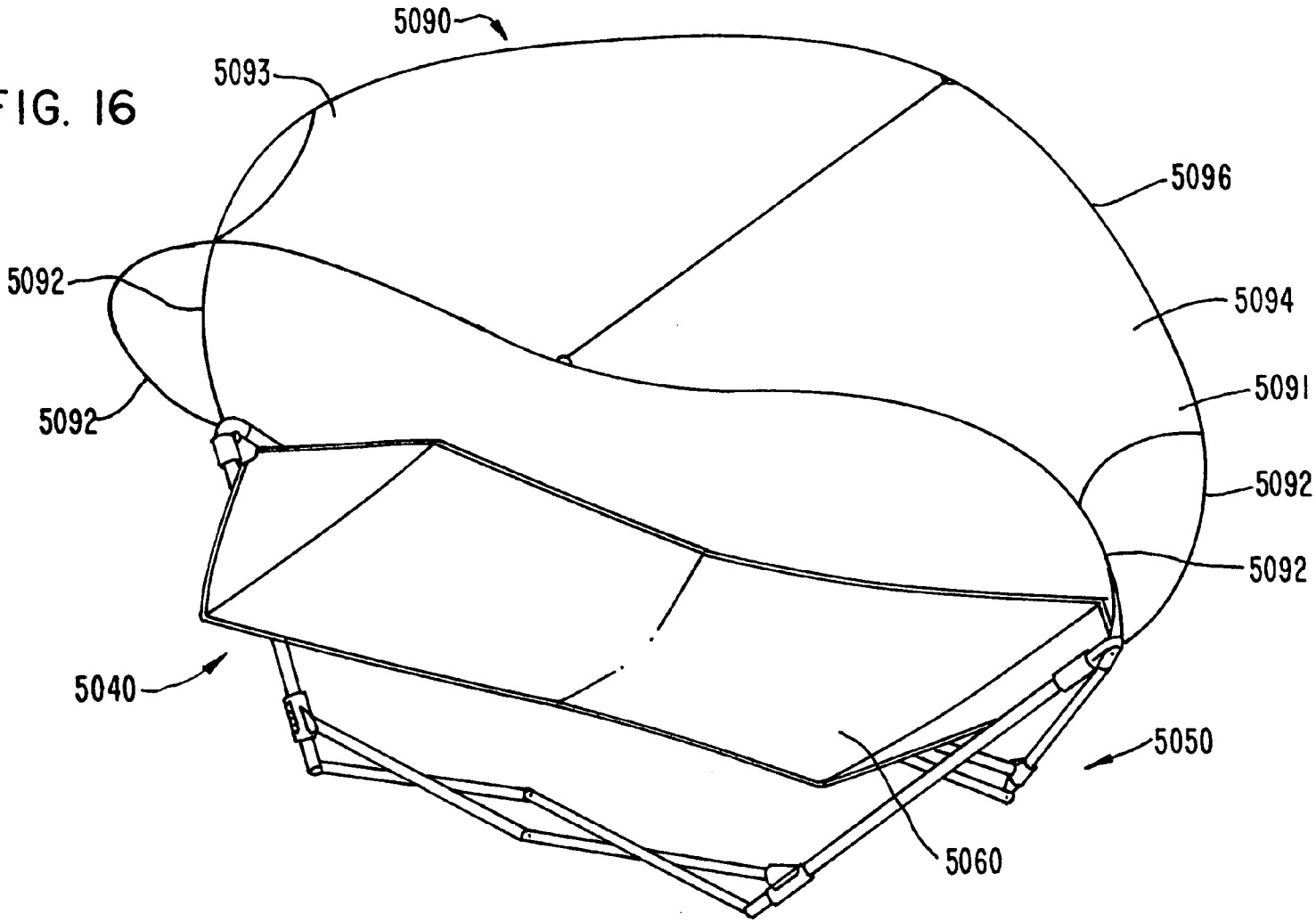

FIG. 16 illustrates an alternative embodiment of a shade member that may be used with an apparatus according to the disclosed invention. The shade member 5090 includes support lines 5092, a membrane portion 5094, and a frame member 5096.

The support lines 5092 couple, and extend between, the shade member 5090 and the support 5040. In the illustrated embodiment, the support lines 5092 are inserted into openings disposed on the end portions of the frame 5050 to releasably couple the support lines to the frame. In alternative embodiments, conventional means, such as a releasable coupler may be used to releasably couple the support lines 5092 to a portion of the support 5040, such as the frame 5050 and/or the hammock member 5060.

In the illustrated embodiment, the membrane portion 5094 is coupled to the frame member 5096, which provides support for the shade member 5090.

While the invention has been described in detail and with references to specific embodiments thereof, it will be apparent to one skilled in the art that various changes and modifications can be made therein without departing from the spirit and scope thereof. Thus, it is intended that the present invention covers the modifications and variations of this invention provided they come within the scope of the appended claims and their equivalents.

What is claimed is:

1. An apparatus, comprising:

a frame having an expanded configuration and a collapsed configuration, the frame including:

a first end portion having a first support member and a second support member, the first support member of the first end portion having a slanted configuration with respect to the second support member of the first end portion when the frame is in its expanded configuration, a second end portion having a first support member and a second support member, the first support member of the second end portion having a slanted configuration with respect to the second support member of the second end portion when the frame is in its expanded configuration, a first side portion having a first connector and a second connector, and a second side portion having a first connector and a second connector, the first connector of the first side portion being disposed at a first position on the first support member of the first end portion of the frame when the frame is in its expanded configuration and being disposed at a second position on the first support member of the first end portion of the frame when the frame is in its collapsed configuration, the first position of the first connector of the first side portion being different than the second position of the first connector of the first side portion, the first connector of the second side portion being disposed at a first position on the second support member of the first end portion of the frame when the frame is in its expanded configuration and being disposed at a second position on the second support member of the first end portion of the frame when the frame is in its collapsed configuration, the first position of the first connector of the second side portion being different than the second position of the first connector of the second side portion, the second connector of the first side portion being disposed at a first position on the first support member of the second end portion of the frame when the frame is in its expanded configuration and being disposed in a second position on the first support member of the second end portion of the frame when the frame is in its collapsed configuration, the first position of the second connector of the first side portion being different than the second position of the second connector of the first side portion, the second connector of the second side portion being disposed at a first position on the second support member of the second end portion of the frame when the frame is in its expanded configuration and being disposed at a second position on the second support member of the second end portion of the frame when the frame is in its collapsed configuration, the first position of the second connector of the second side portion being different than the second position of the second connector of the second side portion.

2. The apparatus of claim 1, further comprising:

a hammock member being coupled to the first end portion of the frame and to the second end portion of the frame.

3. The apparatus of claim 1, wherein the first connector of the first side portion is slideably coupled to the first support member of the first end portion of the frame, the first connector of the second side portion is slideably coupled to the second support member of the first end portion of the frame, the second connector of the first side portion is slideably coupled to the first support member of the second end portion of the frame, the second connector of the second side portion is slideably coupled to the second support member of the second end portion of the frame.

4. The apparatus of claim 1, wherein the first support member of the first end portion of the frame is pivotally coupled to the second support member of the first end portion of the frame, the first support member of the second end portion of the frame is pivotally coupled to the second support member of the second end portion of the frame.

5. The apparatus of claim 1, wherein the first support member of the first end portion is pivotally coupled to the second support member of the first end portion, the first support member of the second end portion is pivotally coupled to the second support member of the second end portion, the first support member of the first end portion of the frame and the second support member of the first end portion of the frame have an extended configuration and a contracted configuration, the first support member of the second end portion of the frame and the second support member of the second end portion of the frame have an extended configuration and a contracted configuration.

6. The apparatus of claim 1, wherein the first support member of the first end portion is pivotally coupled to the second support member of the first end portion, the first support member of the second end portion is pivotally coupled to the second support member of the second end portion, the first support member of the first end portion of the frame and the second support member of the first end portion of the frame have an extended configuration and a contracted configuration, the first support member of the second end portion of the frame and the second support member of the second end portion of the frame have an extended configuration and a contracted configuration, the first support member of the first end portion of the frame includes a first segment and a second segment slideably coupled to the first segment, the second support member of the first end portion of the frame includes a first segment and a second segment slideably coupled to the first segment, the first support member of the second end portion of the frame includes a first segment and a second segment slideably coupled to the first segment, the second support member of the second end portion of the frame includes a first segment and a second segment slideably coupled to the first segment.

7. The apparatus of claim 1, further comprising:

at least one wheel coupled to the frame.

8. The apparatus of claim 1, wherein the first side portion of the frame includes:

a first support member having a first end coupled to the first connector of the first side portion and a second end pivotally coupled to the second end portion of the frame, and a second support member being coupled at a first end to the second connector of the first side portion and a second end pivotally coupled to the first end portion of the frame, and the second side portion of the frame includes:

a first support member having a first end coupled to the first connector of the second side portion and a second end pivotally coupled to the second end portion of the frame, and a second support member having a first end coupled to the second connector of the second side portion and a second end pivotally coupled to the first end portion of the frame.

9. The apparatus of claim 1, wherein the first side portion of the frame includes:

a first support member having a first end pivotally coupled to the first end portion of the frame and a second end pivotally coupled to the second end portion of the frame, and a second support member having a first end coupled to the first connector of the first side portion and a second end coupled to the second connector of the first side portion, the second side portion of the frame includes:

a first support member having a first end pivotally coupled to the first end portion of the frame and a second end pivotally coupled to the second end portion of the frame, and a second support member having a first end coupled to the first connector of the second side portion and a second end coupled to the second connector of the second side portion.

10. The apparatus of claim 1, further comprising:

a hammock member being coupled to the first end portion of the frame and to the second end portion of the frame, the support member including a pocket configured to receive a beverage container.

11. The apparatus of claim 1, further comprising:

a hammock member being coupled to the first end portion of the frame and to the second end portion of the frame, the support member including a pocket configured to receive at least one of a book and a magazine.

12. The apparatus of claim 1, further comprising:

a hammock member being coupled to the first end portion of the frame and to the second end portion of the frame; and a sun shade configured to be removably coupled to at least one of said frame and said support.

13. The apparatus of claim 1, further comprising:

a hammock member being coupled to the first end portion of the frame and to the second end portion of the frame; and a pillow coupled to the hammock member and configured to support the head of a user.

14. The apparatus of claim 1, further comprising:

a hammock member being coupled to the first end portion of the frame and to the second end portion of the frame; and a pillow coupled to the hammock member and configured to support the legs of a user.

15. The apparatus of claim 1, further comprising:

a hammock member being coupled to the first end portion of the frame and to the second end portion of the frame; and a non-linear support member coupled to the hammock member and configured to retain the hammock member in an open configuration.

16. The apparatus of claim 1, wherein the first support member of the first end portion of the frame is substantially parallel to the second support member of the first end portion of the frame when the frame is in its collapsed configuration.

17. The apparatus of claim 1, wherein the first support member of the first end portion of the frame is substantially rigid, the first support member of the second end portion of the frame is substantially rigid.

18. The apparatus of claim 1, wherein the first support member of the first end portion of the frame is monolithically formed, the first support member of the second end portion of the frame is monolithically formed.

19. The apparatus of claim 1, wherein the first support member of the first end portion of the frame is substantially linear, the first support member of the second end portion of the frame is substantially linear.

20. A method of converting an apparatus from a first configuration to a second configuration, the apparatus having a frame including a first end portion having a first support member and a second support member pivotally coupled to the first support member, a second end portion having a first support member and a second support member pivotally coupled to the first support member, a first side portion having a first connector slideably coupled to the first end portion and a second connector slideably coupled to the second end portion, and a second side portion having a first connector slideably coupled to the first end portion and a second connector slideably coupled to the second end portion, comprising:

pivoting the first support member of the first end portion of the frame with respect to the second support member of the first end portion of the frame;

pivoting the first support member of the second end portion of the frame with respect to the second support member of the second end portion of the frame;

sliding the first connector of the first side portion from a first position on the first support member of the first end portion to a second position on the first support member of the first end portion;

sliding the second connector of the first side portion from a first position on the first support member of the second end portion to a second position on the first support member of the second end portion;

sliding the first connector of the second side portion from a first position on the second support member of the first end portion to a second position on the second support member of the first end portion; and sliding the second connector of the second side portion from a first position on the second support member of the second end portion to a second position on the second support member of the second end portion.

21. The method of claim 20, further comprising:

adjusting the first end portion of the frame from a first length to a second length; and adjusting the second end portion of the frame from a first length to a second length.

22. An apparatus, comprising:

a frame having an expanded configuration and a collapsed configuration, the frame including:

a first end portion having a first support member and a second support member, the first support member of the first end portion having a slanted configuration with respect to the second support member of the first end portion when the frame is disposed in its expanded configuration, a second end portion, a first side portion having a first support member and a second support member, the first support member of the first side portion being substantially parallel to the second support member of the first side portion when the frame is disposed in its expanded configuration, the first support member of the first side portion being coupled at a first location of the first support member of the first end portion, the second support member of the first side portion being coupled at a second location of the first support member of the first end portion different than the first location of the first support member for the first end portion, and a second side portion having a first support member and a second support member, the first support member of the second side portion being substantially parallel to the second support member of the second side portion when the frame is disposed in its expanded configuration, the first support member of the second side portion being coupled at a first location of the second support member of the first end portion, the second support member of the second side portion being coupled at a second location of the second support member of the first end portion different than the first location of the second support member of the first end portion.

23. The apparatus of claim 22, wherein the first side portion is slideably coupled to the first end portion and is slideably coupled to the second end portion, the second side portion is slideably coupled to the first end portion and is slideably coupled to the second end portion.

24. The apparatus of claim 22, further comprising:

a hammock member being coupled to the first end portion of the frame and to the second end portion of the frame.

25. The apparatus of claim 22, wherein the first support member of the first end portion of the frame is substantially parallel to the second support member of the first end portion of the frame when the frame is disposed in its collapsed configuration.

26. The apparatus of claim 22, wherein the first support member of the first end portion of the frame is substantially rigid.

27. The apparatus of claim 22, wherein the first support member of the first end portion of the frame is monolithically formed.

28. The apparatus of claim 22, wherein the first support member of the first end portion of the frame is substantially linear.

* * * * *